US009845677B2

(12) United States Patent
Lenaburg et al.

(10) Patent No.: US 9,845,677 B2
(45) Date of Patent: Dec. 19, 2017

(54) CUTTER ASSEMBLY WITH INLINE MOUNTING

(71) Applicant: The Robbins Company, Solon, OH (US)

(72) Inventors: Carl E. Lenaburg, Tacoma, WA (US); Ross D. Galbraith, North Ogden, UT (US)

(73) Assignee: The Robbins Company, Solon, OH (US)

( * ) Notice: Subject to any disclaimer, the term of this patent is extended or adjusted under 35 U.S.C. 154(b) by 0 days.

(21) Appl. No.: 15/335,788

(22) Filed: Oct. 27, 2016

(65) Prior Publication Data

US 2017/0122105 A1 May 4, 2017

Related U.S. Application Data

(60) Provisional application No. 62/247,714, filed on Oct. 28, 2015.

(51) Int. Cl.
*E21D 9/08* (2006.01)
*E21B 10/20* (2006.01)
*E21D 9/10* (2006.01)

(52) U.S. Cl.
CPC ..... *E21D 9/1006* (2013.01); *E21B 10/20* (2013.01); *E21D 9/08* (2013.01)

(58) Field of Classification Search
CPC .... E21D 9/08; E21D 9/10; E21D 9/11; E21D 9/104; E21B 10/10; E21B 10/12; E21B 10/20
USPC ..... 405/138; 299/55, 58; 175/373; 29/426.1
See application file for complete search history.

(56) References Cited

U.S. PATENT DOCUMENTS

| | | | |
|---|---|---|---|
| 4,202,418 | A | 5/1980 | Waddell |
| 4,270,618 | A | 6/1981 | Owens |
| RE31,511 | E | 1/1984 | Spencer |
| 4,548,443 | A | 10/1985 | Turner |

(Continued)

FOREIGN PATENT DOCUMENTS

| | | | |
|---|---|---|---|
| AT | 13486 | U1 * | 11/2013 |
| CA | 2785364 | A1 * | 6/2011 |

(Continued)

OTHER PUBLICATIONS

International Search Report and Written Opinion dated Feb. 3, 2017, issued in corresponding Application No. PCT/US2016/059196, filed Oct. 27, 2016, 9 pages.

*Primary Examiner* — Sunil Singh
(74) *Attorney, Agent, or Firm* — Christensen O'Connor Johnson Kindness PLLC

(57) ABSTRACT

An inline mounting assembly for a TBM cutter assembly includes first and second housing mounts, having upper and lower ear portions, and an inline channel sized to receive an end of the cutter assembly. The housing mounts include a first guide and a second guide defining forward and rearward abutment faces. A wedge assembly includes a bolt that extends through the first guide and engages a wedge configured to clamp the cutter shaft to the housing mount. A back support assembly includes a clamp block that abuts the rearward abutment face, a bridge block that abuts the forward abutment face, and a bolt that extends through the blocks. The bridge block abuts the shaft to provide support.

21 Claims, 6 Drawing Sheets

(56) References Cited

U.S. PATENT DOCUMENTS

| | | | | |
|---|---|---|---|---|
| 5,308,151 | A | 5/1994 | Sugden et al. | |
| 5,421,422 | A | 6/1995 | Crane et al. | |
| 5,598,895 | A | 2/1997 | Anderson et al. | |
| 6,142,577 | A | 11/2000 | Tayama et al. | |
| 8,172,334 | B2 | 5/2012 | Lindbergh et al. | |
| 2009/0297273 | A1 | 12/2009 | Lindbergh | |
| 2013/0045055 | A1* | 2/2013 | Derycke | E21D 9/104 405/138 |
| 2013/0341998 | A1 | 12/2013 | Lenaburg | |
| 2014/0232167 | A1* | 8/2014 | Edelmann | E21D 9/104 299/1.3 |

FOREIGN PATENT DOCUMENTS

| | | | | |
|---|---|---|---|---|
| DE | 102011114830 | B3 | * | 3/2013 |
| JP | 10068293 | A | * | 3/1998 |
| JP | 11-217993 | A | | 8/1999 |
| JP | 2000-17981 | A | | 1/2000 |
| JP | 200770825 | A | * | 3/2007 |
| JP | 2013127182 | A | * | 6/2013 |
| WO | WO 2015063322 | A2 | * | 5/2015 |

* cited by examiner

CUTTER ASSEMBLY WITH INLINE MOUNTING

CROSS-REFERENCE TO RELATED APPLICATION

This application is a claims the benefit of Provisional Application No. 62/247,714 filed Oct. 28, 2015, the disclosure of which is hereby incorporated by reference herein.

BACKGROUND

A tunnel boring machine ("TBM") is a tunnel excavation apparatus for forming tunnels in a variety of soil and rock strata. A conventional TBM produces a smooth circular tunnel wall, with minimal collateral disturbance. As discussed in U.S. Pat. No. 8,172,334, to Lindbergh et al, which is hereby incorporated by reference in its entirety, a conventional TBM typically includes a full face rotatably driven cutterhead that supports a plurality of cutter assemblies. Typically, a cutterhead may have 20, 50, 100, or more cutter assemblies rotatably mounted to the cutterhead.

A breakthrough that made TBMs efficient and reliable was the invention of the rotating head, developed by James S. Robbins. Initially, Robbins' TBM used rigid spikes rotating in a circular motion, but the spikes would frequently break. He discovered that by replacing these grinding spikes with longer lasting rotatable cutter assemblies this problem was significantly reduced. Since then, modern TBMs include rotatable cutter assemblies.

In operation, the cutter head is urged against a surface to be bored such that at least some of the cutter assemblies forcibly engage the surface. In some TBMs a plurality of opposing sets of hydraulic cylinders engage the tunnel walls to anchor the TBM, and separate thrust cylinders press the rotating cutterhead against the rock or ground surface. The cutterhead rotates about a longitudinal axis so that as the cutter assemblies are forcibly pressed against the surface they roll along the surface to fracture, loosen, grind, dislodge, and/or break materials from the surface.

As illustrated in Lindbergh et al., rotatable cutter assemblies are mounted in housings in the TBM cutterhead assembly such that the cutter ring extends forward from the face of the cutterhead assembly to engage the earthen rock wall. During operation of a TBM the cutterhead assembly is pressed with great force against the rock face, typically with hydraulic actuators, while the cutterhead is rotated about its axis. The outer cutter ring of the cutter assemblies produce local stresses that cause the surface of the wall to fracture and crumble. The fractured and loosened material is collected and removed to gradually form the tunnel.

Another illustrative tunnel boring machine is disclosed in U.S. Pat. No. 4,548,443, to Turner, which is hereby incorporated by reference. A main frame for a TBM is disclosed in U.S. Pat. No. RE 31511, to Spencer, which is hereby incorporated by reference in its entirety. A TBM with continuous forward propulsion is disclosed in U.S. Pat. No. 5,205,613, to Brown, which is hereby incorporated by reference. The TBM and a cutter disc assembly and sensor apparatus for a TBM disclosed in U.S. Pat. No. 8,172,334, to Lindbergh et al., provides a means for wireless monitoring the operation of the cutter assemblies.

The cutterhead assembly and the cutter assemblies are subjected to very high forces during tunnel boring operations. Once excavation of the tunnel is started, it is very difficult to repair or replace the cutter assemblies because the assemblies are difficult to access in situ, and the cutter assemblies are heavy, often weighing many hundreds of pounds. Tunnels are often at significant depths, with correspondingly high ambient pressures. Therefore, it is critical that the installation of the cutter assembly in the cutterhead be very secure and reliable, even under the extreme conditions associated with tunnel boring.

FIG. 1 herein shows an exploded view of a conventional cutter assembly housing for a tunnel boring machine, from Lindbergh et al. The cutter assembly 10, comprising a cutter ring 15 disposed on a hub 12 that is mounted for rotation about a shaft 13. Bearing assemblies (not shown) are mounted generally on the shaft 13 to provide for rotation of the hub 12 and cutter ring 15 about the shaft 13.

The conventional cutter housing shown in FIG. 1 comprises spaced-apart housing mounts 20L, 20R (sometimes referred to as mounting plates). Opposite ends of the shaft 13 are secured in the housing mounts 20L, 20R in L-shaped channels 21 (one visible) that are sized to receive the cutter assembly shaft 13. Typically the cutter assembly 10 is installed by positioning the opposite ends of the shaft 13 at the back of the housing mounts 20L, 20R to engage the long leg of the L-shaped channels 21. The cutter assembly 10 is slid along the long leg of the L-shaped channel 21 and then shifted laterally into the recess formed by the shorter leg of the L-shaped channels 21. The cutter housing secures the cutter assembly 10 to the housing mounts 20L, 20R with a pair of wedge-lock assemblies that engage respective ends of the shaft 13.

The wedge-lock assemblies each include a wedge 22, a clamp block 24, and an optional tubular sleeve 28 disposed therebetween. The wedge 22 is positioned to abut an angled face on the end of the shaft 13, and the clamp block 24 engages abutment surfaces 25 on the back end of the associated housing mount 20L, 20R. A bolt 23 extends through the wedge 22, the sleeve 28, and the clamp block 24, and is secured with two nuts 26 and a washer 27. As the bolt 23 is tensioned by torqueing the nuts 26 to a design specification, the wedge 22 locks the cutter assembly 10 in place.

In practice, this mounting has presented certain challenges and disadvantages. For example, the "wedge drop-down" (the cutter assembly 10 lateral shift into the shorter leg of the L-shaped channel 21) required to fit the wedge 22 into place requires space on the TBM cutterhead assembly can be challenging. In a typical installation the cutter assembly 10 drops about 4 inches into the housing pocket of channel 21 to enable installation of the wedge 22 to lock the cutter assembly 10 into positions via the bolt 23 that spans length of the housing mounts 20R, 20L.

In addition, the shallow angle on the wedge 22 is typically relied on to press the cutter assembly 10 laterally into the desired position in the channel 21. The more shallow the wedge angle or lower friction coefficient on the wedge 22, the more effective it is at holding the cutter assembly 10 in position via the mechanical advantage of the wedge 22.

The lateral shift makes it difficult to ensure that the cutter assembly shaft is securely supported in the housing. It will be appreciated by persons of skill in the art that if the shaft is not securely seated in the housing, for example, if any motion between the shaft and the housing develops, the high dynamic forces associated with the tunnel boring process will lead to rapid failure of the assembly. Situating the shaft in the lateral segment of the L-shaped channel makes it very difficult to detect if the shaft is properly seated, and does not provide for an effective mechanism for seating the shaft against both walls in the shifted portion of the channel.

Another disadvantage of this conventional design, that can be particularly prevalent when doing in-field maintenance, is that if dirt or other debris is unintentionally present in the L-shaped channel 21 when the wedge 22 is tightened to secure the cutter assembly 10, and the debris becomes dislodged during operation, the cutter assembly 10 may no longer be suitably secured, which can lead to serious damage to the cutter assembly 10 (and potentially the cutterhead), more rapid wear of the cutterhead 10, and more frequent maintenance requirements.

Also, removal of the cutter assembly 10 from the housing 20L, 20R is challenging, particularly for repair or replacement in the field, because the (heavy) cutter assembly 10 must usually be shifted laterally in the L-shaped channel 21 to align it with the long leg of the channel 21 prior to pulling the cutter assembly out.

There remains a need for improved and more reliable systems for mounting cutter assemblies to the cutterhead in tunnel boring machines.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

An inline mounting assembly for mounting a cutter disc assembly onto a tunnel boring machine (TBM) includes similar first and second mounting subassemblies. The first mounting subassembly includes a housing mount with a body portion and a front end with inwardly extending first and second ears, and a channel extending from a back end to the front end. First and second guides are provided on either side of the channel to define front and back abutment surfaces. A wedge assembly includes an elongate member, for example a bolt, that extends through an aperture in the first guide, and a wedge that engages a distal end of the elongate member. A back support assembly includes a second elongate member that extends through a clamp block that abuts the back abutment surface and engages a bridge block that abuts the front abutment surface. A front end of the bridge block is configured to abut a shaft of the cutter disc assembly, and the wedge is configured to slideably engage the first ear of the housing mount and the shaft, such that the shaft is clamped between the wedge and the second ear of the housing mount.

In an embodiment the second mounting subassembly is substantially identical to the first mounting subassembly in mirror image.

In an embodiment the first elongate member is a bolt that threadably engages the wedge and is configured to apply an adjustable force on the wedge.

In an embodiment the first guide is a substantially uniform rectangular protrusion from the body of the housing mount.

In an embodiment a back end of the first and second guides define recesses configured to receive the clamp block.

In an embodiment the bridge block comprises a relatively wide back face that abuts the front abutment surface and a relatively narrow front face that is configured to abut the shaft.

In an embodiment the second elongate attachment member comprises a bolt that is configured to engage the shaft of the cutter disc assembly.

In an embodiment the housing mount is formed as a single-piece unitary mount.

In an embodiment the first guide or the second guide, or both, are removably attached to the body portion of the housing mount.

In an embodiment the second elongate member is configured to preload the shaft of the cutter assembly against the bridge block.

A cutter assembly and inline mount for a tunnel boring machine includes a cutter assembly having a shaft and a cutter ring or disc disposed on a hub that is rotatably mounted to the shaft. An inline mounting assembly has first and second mounting subassemblies. The mounting subassemblies include (i) a mounting plate having a body portion and a front end with inwardly extending first and second shaft supporting portions, the mounting plate having a channel extending from a back end of the mounting plate to the front end and sized to receive an end of the shaft, a first guide disposed on one side of the channel, and a second guide disposed on the other side of the channel, wherein the first guide and the second guide cooperatively define a back abutment surface and a front abutment surface; (ii) a wedge assembly comprising a first elongate attachment member that extends through an aperture in the first guide and a wedge that engages a distal end of the first elongate attachment member; (iii) a back support assembly comprising a clamp block that abuts the back abutment surface, a bridge block that abuts the front abutment surface, and a second elongate attachment member that extends through an aperture in the clamp block and an aperture in the bridge block. A front end of the bridge block is configured to abut the shaft. The wedge is configured to slideably engage the first inwardly extending shaft supporting portion, and to slideably engage the shaft such that the shaft is clamped between the wedge and the second inwardly extending shaft supporting portion of the mounting plate.

In an embedment the second mounting subassembly is substantially identical to the first mounting subassembly in mirror image.

In an embodiment the first elongate member has a first bolt that engages the wedge and is configured to apply an adjustable rearward force on the wedge.

In an embodiment the first guide is formed as a substantially uniform rectangular protrusion.

In an embodiment a back end of the first guide defines a first recess and a back end of the second guide defines a second recess, and the recesses cooperatively receive the clamp block.

In an embodiment the bridge block is shaped as an isosceles trapezoid with a relatively narrow front face that is configured to abut the shaft.

In an embodiment the second elongate attachment member comprises a bolt that threadably engages the shaft of the cutter disc assembly.

In an embodiment the mounting plate is formed as a single-piece unitary mount.

In an embodiment the first guide and the second guide are removably attached to the body portion of the mounting plate.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
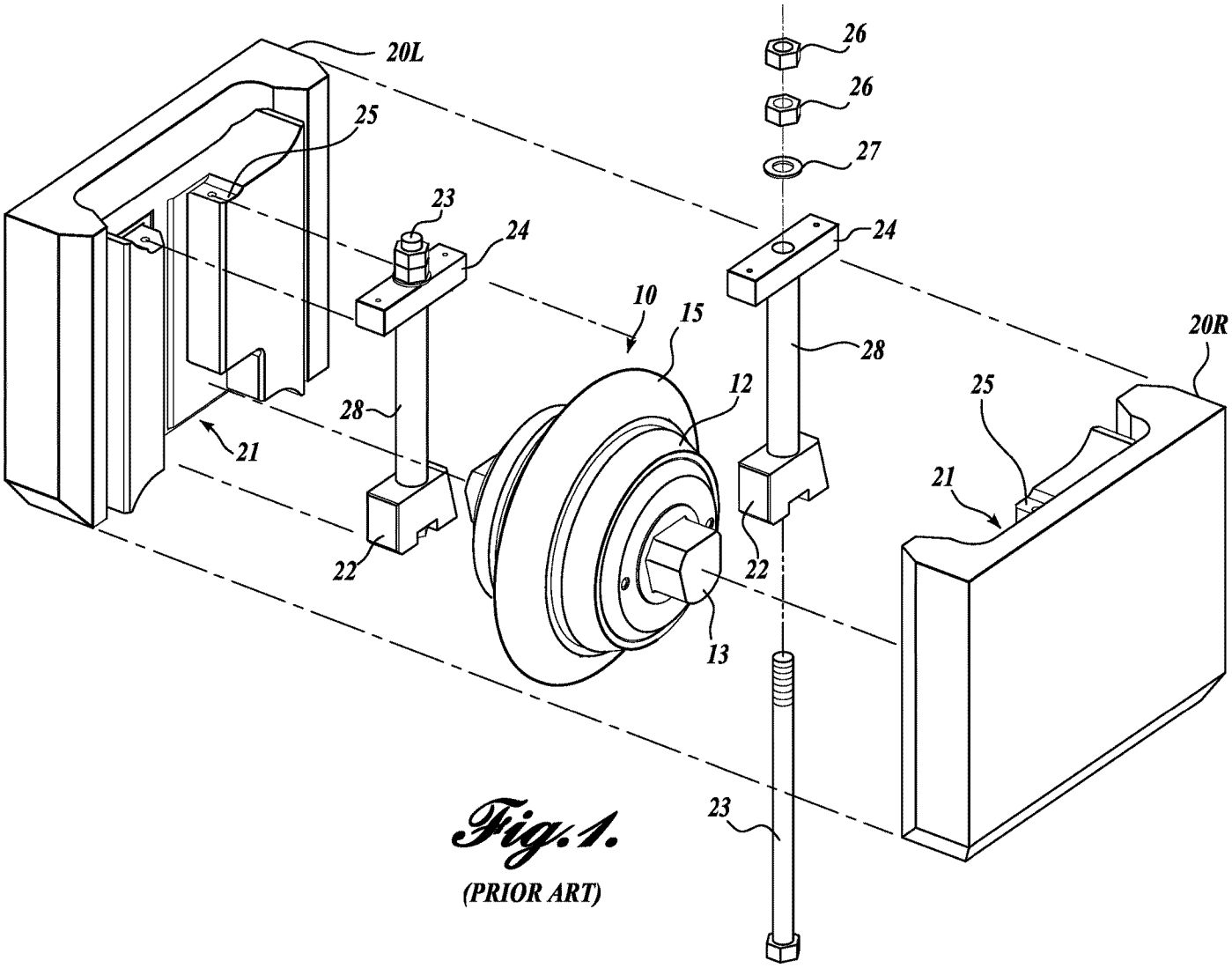
Fig. 1. (PRIOR ART)
FIG. 1 is a perspective, partially exploded view of a prior art cutter assembly and mounting system.

A TBM cutter attachment and housing assembly in accordance with the present invention overcomes the disadvantages described above. An exemplary embodiment of the cutter attachment and housing assembly 100 is shown in a right-rear perspective view in FIG. 2, with a cutter assembly 115 installed. In this embodiment, a pair of housing mounts 120, which are configured to be attached to the main cutterhead assembly (not shown), are each provided with a wedge assembly 130 and a back support assembly 140. The wedge assembly 130 and back support assembly 140 cooperate to secure the cutter assembly 115 in the housing 120 such that the cutter assembly 115 is rotatable on a shaft 117 (see FIG. 3), with a portion of the cutter assembly 115 extending forwardly from the housing 120. Importantly, the shaft 117 is inserted along a straight-line channel 123 without requiring any shift away from the channel, and is supported inline.

Figure 3:
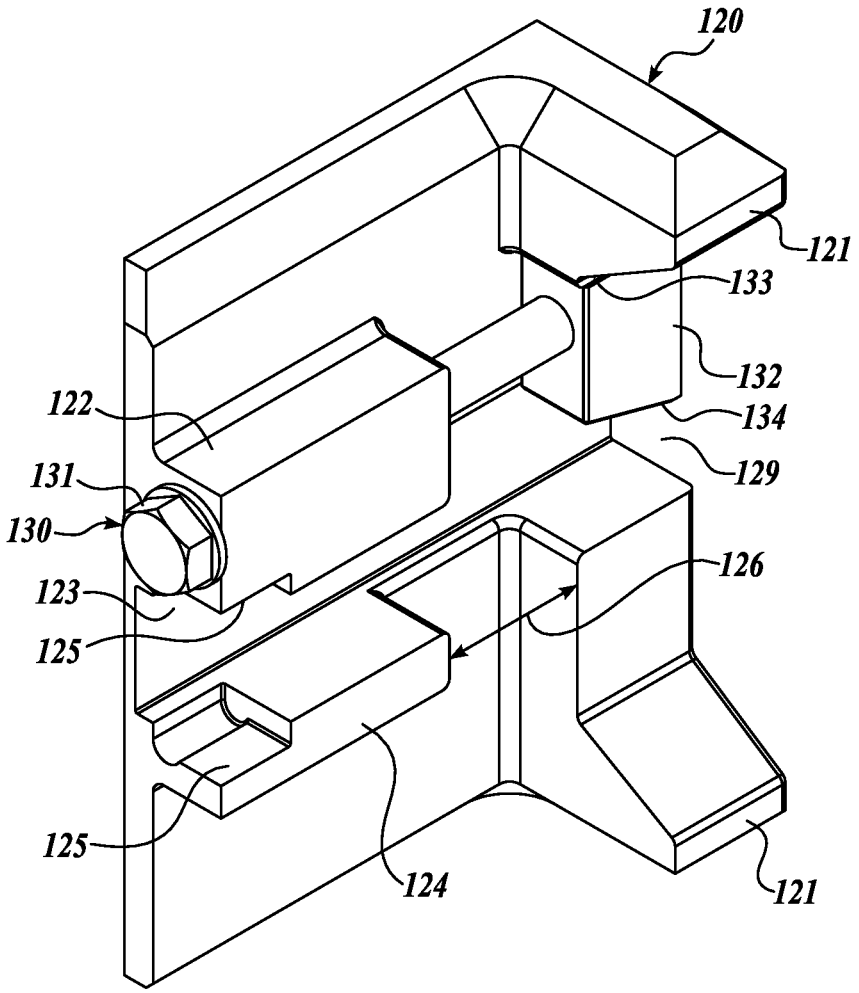
FIG. 3 is a perspective view of the left housing mount shown in FIG. 2, with the wedge assembly installed, wherein the right housing mount and related components are omitted for clarity.
Figure 6:
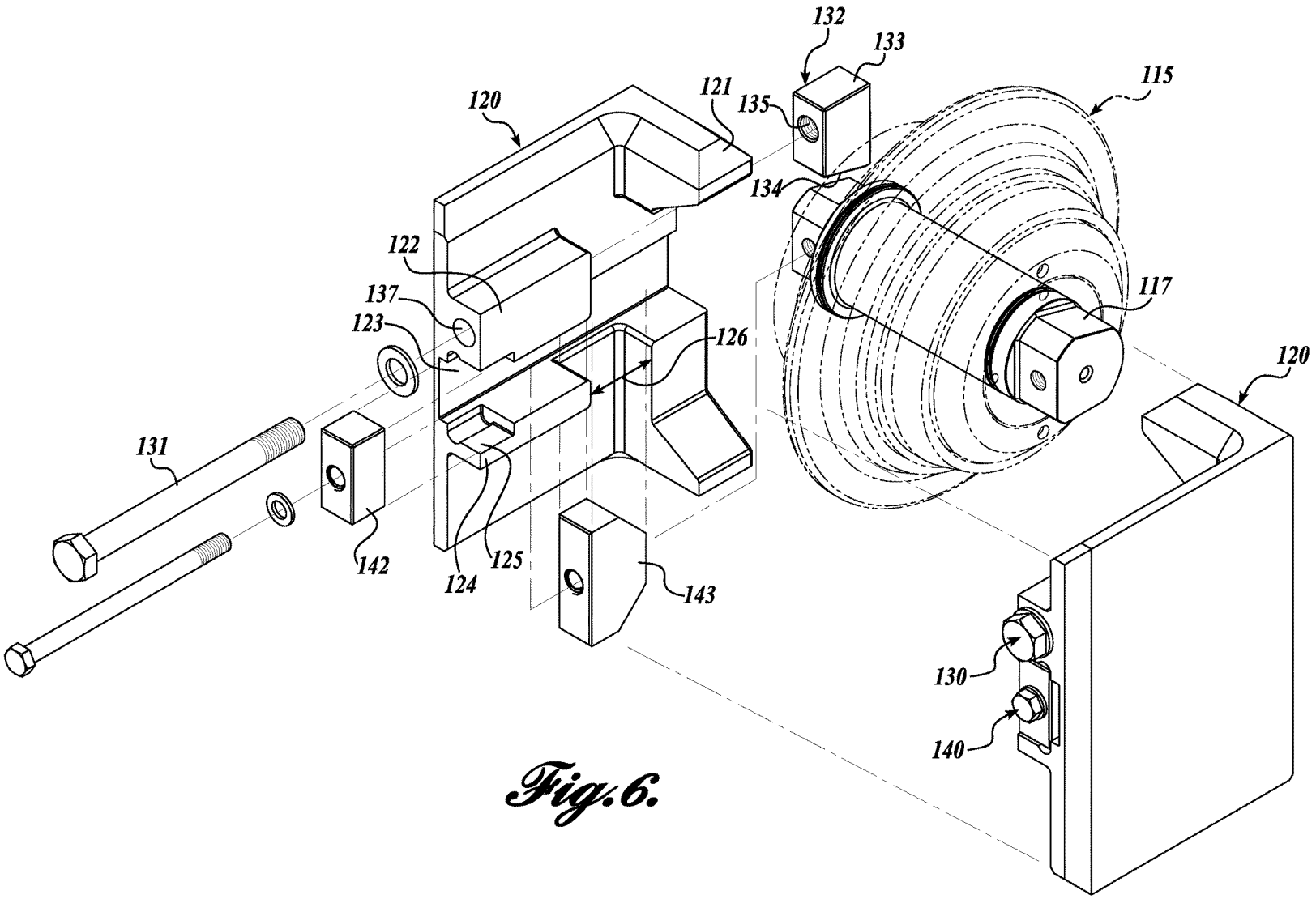
FIG. 6 is a partially exploded view illustrating insertion of the cutter ring assembly into the housing assembly shown in FIG. 2.

FIG. 3 shows the left housing mount 120 with the wedge assembly 130 installed to the mount 120. In order to show other aspects of the assembly, the right housing mount 120 and other components are not shown. Refer also to FIG. 6, which shows an exploded view of one side of the housing assembly 100.

In a current embodiment the right housing mount 120 is substantially similar in mirror symmetry to the left housing mount 120. In some embodiments there may be advantages or reasons for various differences between the left and right housing mounts and related components, for example, to accommodate mounting on a particular cutterwheel design or to simplify the assembly. The housing mount 120 includes upper and lower protrusions or ears 121 that extend inwardly from the body of the housing mount 120. The ears 121 reduce the exposed cutter opening, serve to spread the wedge and cutter tangential loads to the cutterhead structure, and provide surfaces for reacting clamping forces supporting and securing the cutter assembly shaft 117.

The housing mount 120 includes a bolt guide 122 as shown in FIG. 3 having a through-hole 137 configured to slideably receive an attachment member, for example, a bolt 131 for the wedge assembly 130. The bolt 131 extends through the through-hole 137 in the bolt guide 122 and engages a wedge 132. For example, the wedge 132 may be threadably attached to the bolt 131. An upper face 133 of the wedge 132 is configured to slideably engage a lower face of the associated ear 121 of the housing mount 120. An angled lower face 134 is configured to slideably engage a corresponding face of the shaft 117 end (FIG. 6).

Figure 4:
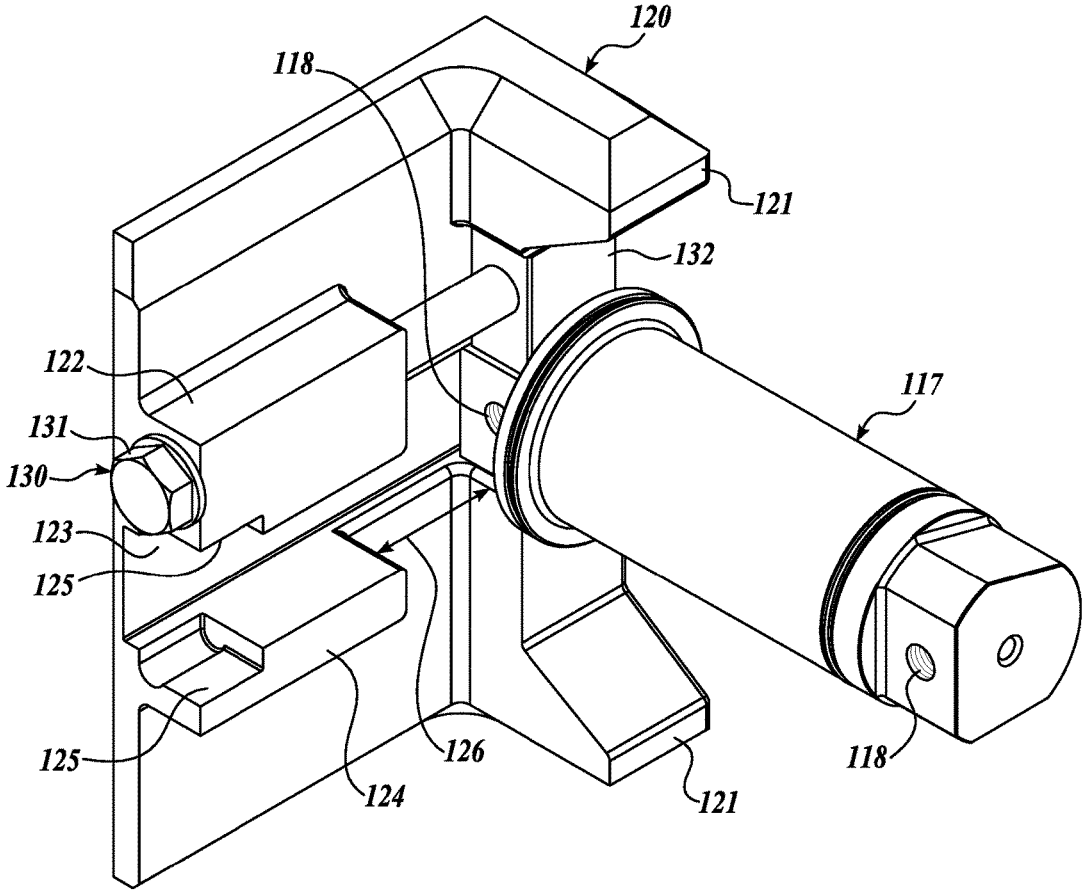
FIG. 4 is a perspective view of the left housing mount shown in FIG. 2, with the cutter assembly shaft inserted, wherein the body of the cutter assembly is omitted for clarity.

FIG. 4 shows the subassembly of FIG. 3, with the cutter assembly shaft 117 positioned to engage the wedge 132. It will be appreciated that as the bolt 132 is tightened the wedge is pulled rearwardly by the bolt 132. Therefore, the cutter assembly shaft 117 is clampingly engaged between the wedge 132 and the lower ear portion 121 of the housing 120 to secure the cutter assembly 115 in the housing. The wedge 132, which engages a face on the shaft 117, is angled such that tightening the bolt 132 also causes the wedge 132 to also apply a rearward force on the shaft 117 end. The opposite end of the shaft 117 is similarly clamped by the other housing mount 120.

The housing mount 120 in this embodiment further defines a channel 123 that extends along the length of the housing mount 120. The channel 123 is sized to receive an end of the cutter assembly shaft 117. The left and right housing mounts 120 will therefore receive opposite ends of the shaft 117, allowing the cutter assembly to be positioned in the mount by sliding the cutter assembly from the back end of the mounts 120 to the front end. The corresponding wedges 132 may be prepositioned to prevent the cutter assembly 115 from traveling too far along the channel 123.

Referring still to FIGS. 3 and 4, the housing mounts 120 (one shown) further include a second guide or abutment member 124 that is generally parallel to, and spaced apart from, the bolt guide 122. The second guide 124 is located on the opposite side of the channel 123 as the bolt guide 122. The bolt guide 122 and the second guide 124 each include corresponding recesses 125 at the back end of the housing mount 120. The recesses 125 are sized and positioned to cooperatively receive and abut a clamp block 142 as shown in FIG. 5, and discussed below.

The bolt guide 122 and the second guide 124 extend only part way towards a front end of the housing mount 120, thereby cooperatively defining a gap 126, for the back support assembly 140.

Figure 5:
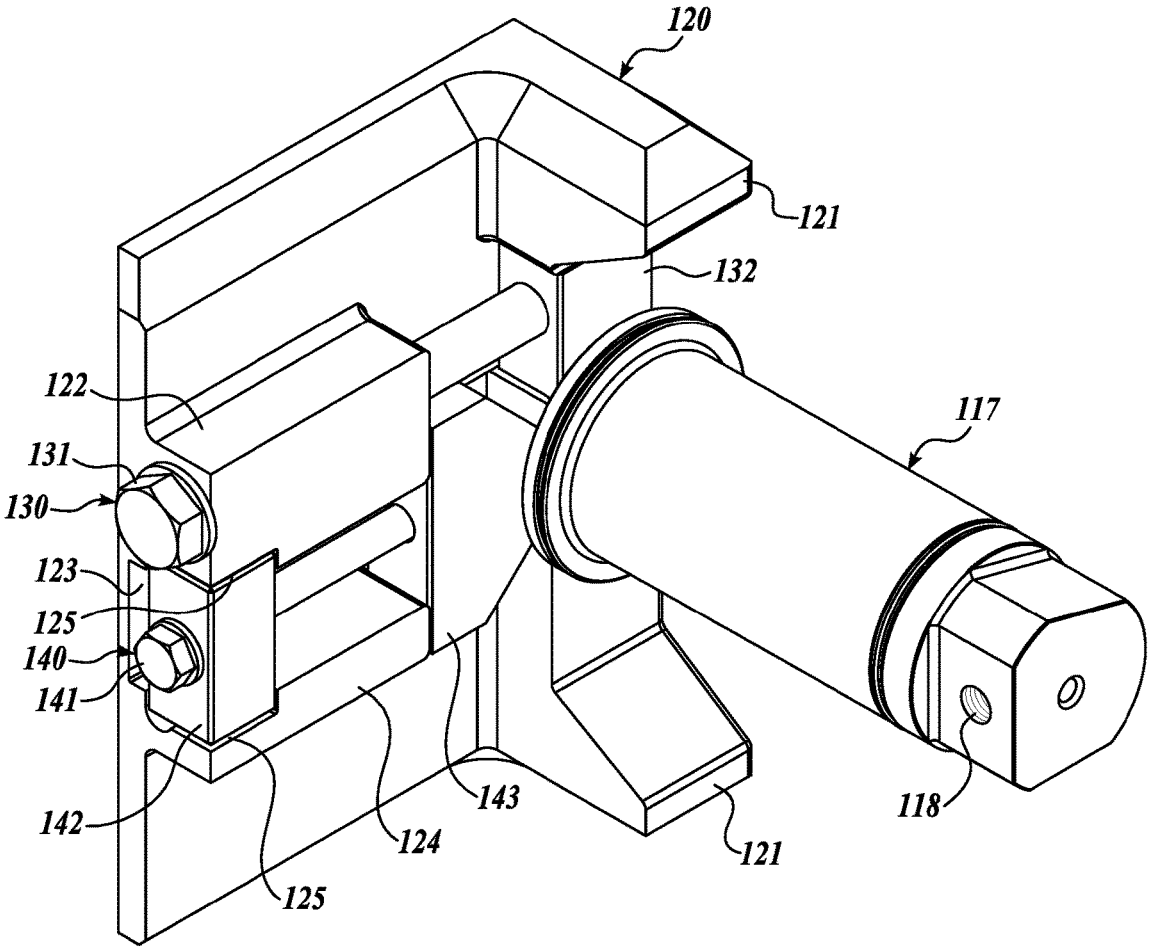
FIG. 5 is a perspective view of the left housing mount shown in FIG. 2, with the back support assembly also shown installed.

FIG. 5 is similar to FIG. 4, with the back support assembly 140 also installed in the housing mount 120. Refer also to the exploded view in FIG. 6. The back support assembly 140 includes an attachment member, for example, a bolt 141 that extends through the clamp block 142 and to or through a bridge block 143. In this embodiment the bolt 141 threadably engages the cutter assembly shaft 117 through the threaded aperture 118. Other attachment mechanisms may alternatively be used. In an alternative embodiment the bolt 141 is configured to attach directly to the bridge block 143, and the bridge block 143 abuts the shaft 117. The clamp block 142 is sized to engage and abut the recesses 125 in the bolt guide 122 and the second guide 124, as discussed above.

The bridge block 143 abuts forward ends of the bolt guide 122 and the second guide 124. The bridge block 143 may be suitably positioned by sliding the bridge block 143 through the gap 126 between the second guide 124 and the lower ear portion 121 (e.g., moving upwardly in FIG. 6), before inserting the bolt 141. The bridge block 143 therefore bridges the ends of the bolt guide 122 and the second guide 124 nearest the shaft 117.

Tightening the bolt 141 to a design torque securely seats the cutter assembly shaft 117 against the bridge block 143. The wedge assembly bolt 131 is tightened to secure the cutter assembly 115 in the housing mounts 120. The wedge assembly 130 securely clamps the shaft 117 between the wedge 132 and the upper face of the lower ear portion 121 of the housing mount 120.

In contrast to prior art cutter assembly mounting assemblies, the cutter assembly 115 is mounted inline, slideably inserting the ends of the cutter assembly shaft 117 into the opposed channels 123 of the housing mounts 120, and sliding the cutter assembly 115 forward, without requiring the "wedge drop-down" or lateral shift discussed above. Thus the wedge 132 may be optimized for providing the maintaining lateral clamping of the cutter assembly 115 via the mechanical advantage provided by the wedge.

The disclosed system 100 simplifies mounting and removing cutter assemblies 115 from the cutterhead.

For example, in some instances to install the cutter assembly 115 the left and right wedge assemblies 130 are installed and the cutter assembly 115 is then positioned to slideably engage the opposed channels 123 from the back and slide forward until the shaft 117 ends engage the wedges 132. For each housing mount 120 the clamp block 142 is positioned in the recesses 125, the bridge block 143 is inserted through the gap 126 between the shaft 117 and the bolt guide 122 second guide 124, and the second bolt 141 is inserted through both blocks 142, 143 and threadably engages the corresponding aperture 118 in the shaft 117. In embodiments wherein the second bolt 141 threadably engages the shaft 117, tightening the second bolt 141 preloads the shaft 117 securely against the bridge block 143.

Tightening the second bolt to a first design torque secures the shaft 117 to the bridge block 143, and tightening the bolt 131 secures the shaft 117 laterally in the housing mount 120. In some cases the cutter assembly 117 may alternatively be positioned in the channels 123 from the front end of the housing mounts 120, prior to installing the wedge assemblies 130, and the wedge assembly 130 and back support assembly 140 installed in situ.

Removal of the cutter assembly 117, for example, for replacement or maintenance in the field, is simplified because the cutter assembly 115 does not have to be shifted laterally to be in a position for removal. After removal of the back support assembly 140 and loosening the wedge assembly 130, the cutter assembly 115 may be simply pulled rearwardly along the channels 123.

In the disclosed inline loading system, the cutter assembly 115 slides directly into the mounted position. The bridge block 143 is located directly behind the cutter assembly shaft 117, which is clamped initially against the bridge block 143 to fully position the cutter assembly 115. The wedge 132 is then drawn into position to lock the cutter assembly 115 in place. In prior art systems the position of the cutter in the housing is not established prior to the wedge being engaged, and the cutter assembly change personnel cannot see if the housing seats are cleaned properly or even see if the cutter is positioned properly.

Figure 2:
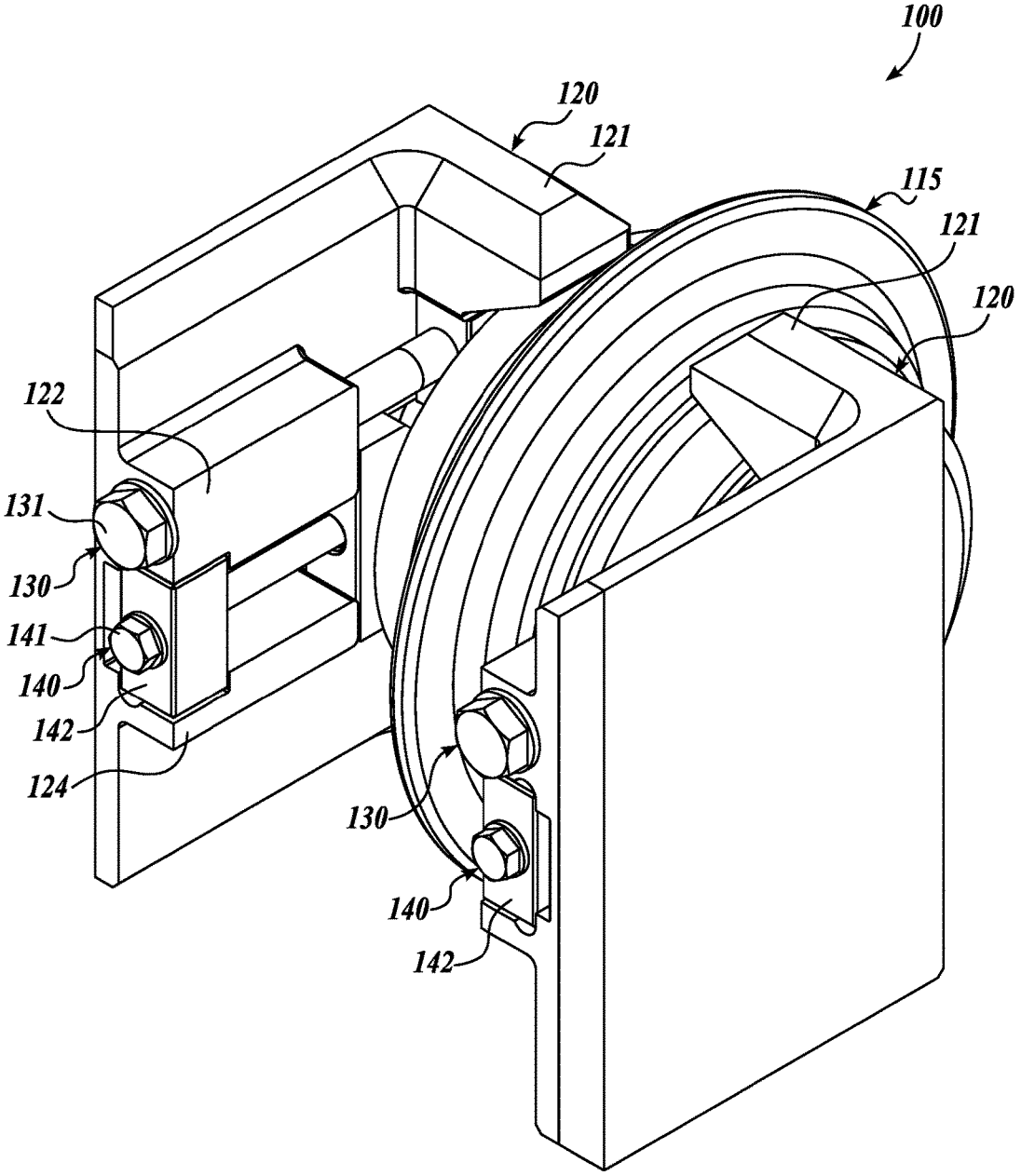
FIG. 2 is a perspective view of a cutter assembly mounted in a cutter attachment and housing assembly, in accordance with the present invention.

The housing assemblies such as the housing assembly 100 of FIG. 2 may also be smaller than conventional housing systems (for example, the prior art system shown in FIG. 1) because the housing mounts use an inline mounting channel, and do not require prior art L-shaped channels 21.

Although the bolt guide 122 and the abutment guide 124 in the current embodiment are generally rectangular and unitary protrusions from the body portion of the housing mount 120, it is contemplated that these members may be formed as multiple short protrusions. For example, the bolt guide 122 may be formed as two or more aligned lugs, for example, a first lug located at or near a back end of the housing mount 120 and providing an abutment for the clamp block 142, and a second lug located at or near the front end of the bolt guide 122 shown in FIG. 3, providing an abutment for the bridge block 143.

Although in the currently current embodiment shown in FIG. 2 each of the housing mounts 120 are formed as an unitary construction, it is contemplated that the housing mounts 120 may alternatively be formed as an assembly or modularly, to improve maintainability of the assembly 100, and/or to improve manufacturability. In particular, in another embodiment the first and second guides 122, 124 may be formed as separable portions of the housing mount 120. The guides 122, 124 experience higher cyclical loadings than other portions of the housing mount 120, and therefore may be more susceptible to damage. It is contemplated that the first guide 122 and/or the second guide 124 may be formed separately, and assembled to the back portion to form the housing mount 120, for example with bolts or other attachment means as are known in the art. In an exemplary embodiment the back plate portion of the housing mount 120 includes recesses for slideably receiving and securing such modular guides 122, 124. An assembled housing mount 120 would facilitate repair and/or maintenance of the assembly 100, allowing users to replace the guides 122, 124 if they become worn or damaged without removing the entire mount 120 from the cutterwheel. Separable guides 122, 124 would also allow the guides 122, 124 to be formed from a different material than the rest of the housing mount 120. Separable guides 122, 124 would also allow the assembly 100 to be customized or modified, for example to accommodate different cutter assemblies 115.

While illustrative embodiments have been illustrated and described, it will be appreciated that various changes can be made therein without departing from the spirit and scope of the invention.

The embodiments of the invention in which an exclusive property or privilege is claimed are defined as follows:

1. An inline mounting assembly for mounting a cutter disc assembly onto a tunnel boring machine, the mounting assembly comprising a first mounting subassembly and a second mounting subassembly that is similar to the first mounting subassembly, wherein the first mounting subassembly comprises:

a housing mount having a body portion and a front end with inwardly extending first and second ears, the housing mount having a channel extending from a back end of the housing mount to the front end, a first guide disposed on one side of the channel, and a second guide disposed on the other side of the channel, wherein the first guide and the second guide define a back abutment surface and a front abutment surface;

a wedge assembly comprising a first elongate attachment member that extends through an aperture in the first guide and a wedge that engages a distal end of the first elongate attachment member;

a back support assembly comprising a clamp block that abuts the back abutment surface, a bridge block that abuts the front abutment surface, and a second elongate attachment member that extends through an aperture in the clamp block and an aligned aperture in the bridge block;

wherein a front end of the bridge block is configured to abut a shaft of the cutter disc assembly, and the wedge is configured to slideably engage the first ear of the housing and to slideably engage the shaft such that the shaft is clamped between the wedge and the second ear of the housing mount.

2. The mounting assembly of claim 1, wherein the second mounting subassembly is substantially identical to the first mounting subassembly in mirror image.

3. The mounting assembly of claim 1, wherein the first elongate member comprises a first bolt, and the first bolt threadably engages the wedge and is configured to apply an adjustable rearward force on the wedge.

4. The mounting assembly of claim 1, wherein the first guide comprises a substantially uniform rectangular protrusion.

5. The mounting assembly of claim 1, wherein a back end of the first guide defines a first recess and a back end of the second guide defines a second recess, wherein the first and second recesses are configured to cooperatively receive the clamp block.

6. The mounting assembly of claim 1, wherein the bridge block comprises a relatively wide back face that abuts the front abutment surface and a relatively narrow front face that is configured to abut the shaft.

7. The mounting assembly of claim 1, wherein the second elongate attachment member comprises a bolt.

8. The mounting assembly of claim 7, wherein the bolt is configured to threadably engage the shaft of the cutter disc assembly.

9. The mounting assembly of claim 1, wherein the housing mount is formed as a single-piece unitary mount.

10. The mounting assembly of claim 1, wherein at least one of the first guide and the second guide are removably attached to the body portion of the housing mount.

11. The mounting assembly of claim 1, wherein the second elongate attachment member is configured to threadably engage the shaft of the cutter assembly and to preload the shaft of the cutter assembly against the bridge block.

12. A cutter assembly and inline mount for a tunnel boring machine comprising:

a cutter assembly comprising a shaft and a cutter ring disposed on a hub that is rotatably mounted to the shaft;

an inline mounting assembly for mounting the cutter assembly onto the tunnel boring machine, the mounting assembly comprising a first mounting subassembly and a second mounting subassembly that is similar to the first mounting subassembly, wherein the first mounting subassembly comprises:

a mounting plate having a body portion and a front end with inwardly extending first and second shaft supporting portions, the mounting plate having a channel extending from a back end of the mounting plate to the front end and sized to receive an end of the shaft, a first guide disposed on one side of the channel, and a second guide disposed on the other side of the channel, wherein the first guide and the second guide cooperatively define a back abutment surface and a front abutment surface;

a wedge assembly comprising a first elongate attachment member that extends through an aperture in the first guide and a wedge that engages a distal end of the first elongate attachment member;

a back support assembly comprising a clamp block that abuts the back abutment surface, a bridge block that abuts the front abutment surface, and a second elongate attachment member that extends through an aperture in the clamp block and an aperture in the bridge block;

wherein a front end of the bridge block is configured to abut the shaft, and wherein the wedge is configured to slideably engage the first inwardly extending shaft supporting portion, and to slideably engage the shaft such that the shaft is clamped between the wedge and the second inwardly extending shaft supporting portion of the mounting plate.

13. The cutter assembly and inline mount of claim 12, wherein the second mounting subassembly is substantially identical to the first mounting subassembly in mirror image.

14. The cutter assembly and inline mount of claim 12, wherein the first elongate member comprises a first bolt, and the first bolt threadably engages the wedge and is configured to apply an adjustable rearward force on the wedge.

15. The cutter assembly and inline mount of claim 12, wherein the first guide comprises a substantially uniform rectangular protrusion.

16. The cutter assembly and inline mount of claim 12, wherein a back end of the first guide defines a first recess and a back end of the second guide defines a second recess, wherein the first and second recesses are configured to cooperatively receive the clamp block.

17. The cutter assembly and inline mount of claim 12, wherein the bridge block comprises a relatively wide back face that abuts the front abutment surface and a relatively narrow front face that is configured to abut the shaft.

18. The cutter assembly and inline mount of claim 12, wherein the second elongate attachment member comprises a bolt.

19. The cutter assembly and inline mount of claim 18, wherein the bolt is configured to threadably engage the shaft of the cutter disc assembly.

20. The cutter assembly and inline mount of claim 12, wherein the mounting plate is formed as a single-piece unitary mount.

21. The cutter assembly and inline mount of claim 12, wherein at least one of the first guide and the second guide are removably attached to the body portion of the mounting plate.

* * * * *